US009982935B2

(12) United States Patent
Webber et al.

(10) Patent No.: US 9,982,935 B2
(45) Date of Patent: May 29, 2018

(54) CRYOGENIC SYSTEM WITH RAPID THERMAL CYCLING

(75) Inventors: Robert J. Webber, Clinton Corners, NY (US); Jean Delmas, Fishkill, NY (US)

(73) Assignee: HYPRES, INC, Elmsford, NY (US)

( * ) Notice: Subject to any disclaimer, the term of this patent is extended or adjusted under 35 U.S.C. 154(b) by 566 days.

(21) Appl. No.: 12/925,370

(22) Filed: Oct. 20, 2010

(65) Prior Publication Data

US 2012/0096873 A1 Apr. 26, 2012

(51) Int. Cl.

| | |
|---|---|
| ***F17C 7/00*** | (2006.01) |
| ***F25B 19/00*** | (2006.01) |
| ***F25D 19/00*** | (2006.01) |
| ***H01F 6/04*** | (2006.01) |

(52) U.S. Cl.

CPC ..... *F25D 19/006* (2013.01); *H01F 6/04* (2013.01); *F25D 2400/02* (2013.01)

(58) Field of Classification Search

CPC ..... F17C 3/085; F17C 2205/0332–2205/0335
USPC ..... 62/48.3, 50.4, 50.7, 51.1
See application file for complete search history.

(56) References Cited

U.S. PATENT DOCUMENTS

| | | | | |
|---|---|---|---|---|
| 3,807,396 | A * | 4/1974 | Fischel | 128/201.21 |
| 5,293,750 | A * | 3/1994 | Tamura et al. | 62/47.1 |
| 6,199,399 | B1 * | 3/2001 | Voorhis | F25B 41/062 62/324.1 |
| 7,263,839 | B2 * | 9/2007 | Overweg | F25D 29/001 62/259.2 |

* cited by examiner

*Primary Examiner* — Tareq Alosh
(74) *Attorney, Agent, or Firm* — Henry I. Schanzer

(57) ABSTRACT

A fluid control assembly is connected between a cold gas container intended to be operated at deep cryogenic temperatures (e.g., 4K) and a gas reservoir for controlling the flow of fluid between the container and the reservoir. The fluid control assembly may be a passive valve assembly or an electrically controlled valve assembly which controls fluid flow between the reservoir and the container as a function of temperature and/or pressure differentials. The fluid control assembly enables the container to be rapidly cooled by restricting the amount of fluid flow from the reservoir into the container when the container is subjected to thermal cycling within a limited temperature range (e.g., 4K to 11K). The fluid control assembly together with the gas reservoir and the container form a thermal damper which is suited for use in a cryocooling system for producing the cryogenic temperatures (e.g., 4K) to operate superconducting devices which may need to be thermally cycled to remove trapped flux.

14 Claims, 8 Drawing Sheets

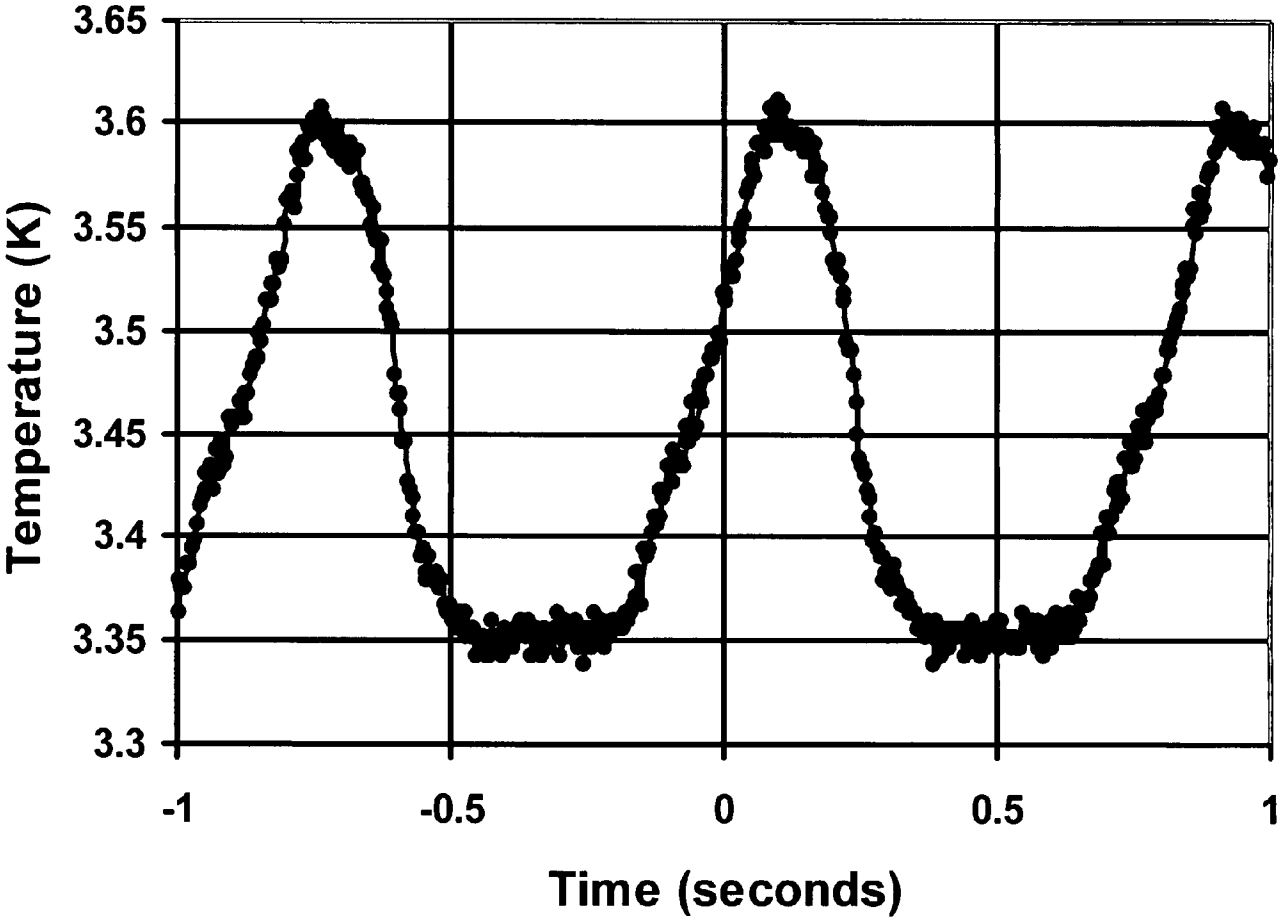
Fig. 1B. Prior Art Thermal Oscillations

CRYOGENIC SYSTEM WITH RAPID THERMAL CYCLING

BACKGROUND OF THE INVENTION

This invention relates to apparatus and methods for providing highly stable deep cryogenic temperatures and for enabling rapid thermal cycling at cryogenic temperatures.

Suitable apparatus for providing deep cryogenic temperatures include cryogenic refrigerators, also referred to as cryocoolers. To attain temperatures near absolute zero degrees Kelvin, a known available working cooling fluid is helium (He). The term "cooling fluid" as used herein refers to the working coolant (e.g., He) whether in a liquid, gaseous or any intermediate state and "degrees Kelvin" may be denoted herein by the capital letter "K".

A variety of different thermodynamic approaches are used in commercial helium-cycle cryocoolers, including Gifford-McMahon (GM), pulse tube, and Stirling cycles. See, for example, "Cryocoolers: The State of the Art and Recent Developments", R. Radebaugh, J. Physics Condensed Matter, vol. 21, 164219 (2009).

Known cryocoolers of the type shown in Prior art FIG. 1A suffer from temperature oscillators/variations (about a set temperature) as shown in FIG. 1B. The temperature variations present in the system of FIG. 1A may be substantially reduced by the introduction of a thermal damper as shown in FIG. 2. Adding the thermal damper of FIG. 2 to cryocoolers of the type shown in FIG. 1A, functions to add thermal capacitance to the system which reduces the thermal oscillations shown in FIG. 1B. However, the thermal damper functions to slow down the cooling response of the system which is undesirable in applications where it is desirable and/or necessary to have rapid cycling between two different (cryogenic) temperature levels. The need for a faster dynamic response conflicts with the desirable and/or necessary condition that once the operating temperature level is set, it be and remain very stable (i.e., that it not vary significantly or substantially with time).

The problems discussed above may be better understood with reference to FIGS. 1A, 1B and 2. FIG. 1A shows an insulating vacuum enclosure 230 containing a first, intermediate temperature, cooling stage 240 and a second, low temperature, cooling stage 260. FIG. 1A also shows, in a highly simplified form, apparatus (compressor 150, high and low pressure lines 153 and 155, cryocooler ambient stage 160 and pistons 242 and 262) for distributing cooling fluid (e.g., helium gas) to operate the first and second cooling stages (240, 260) and produce the desired cryogenic temperatures. When operational, cooling stage 240 may function to produce an intermediate temperature in the range of 40-70 K and cooling stage 260 may function to produce temperatures in the range of less than 3K to more than 10 K. The use of two stages is merely illustrative; some cryocoolers may have only one stage, while others may have three or more cascaded stages.

A device to be cryocooled, DUT 226, which may, for example, be a superconductive integrated circuit, (SIC), is thermally linked to the cold stage 260; (container 220 in FIG. 2). A thermometer or temperature sensor, 224, and a resistive electrical heater 228 are shown attached to stage 260; (container 220 in FIG. 2).

A problem with the cryocooler system of FIG. 1A is that it is operated with a low frequency cyclic process (e.g., on the order of 1 Hz) which in turn causes the cooling power to oscillate/vary at this frequency. Depending on the heat generation and the thermal mass (heat capacity) of the system, the temperature of the coldest stage (e.g., 260 in FIG. 1A) oscillates or varies. For example, a two-stage GM cryocooler of the type shown in FIG. 1A typically exhibits peak-to-peak temperature oscillations/variations of the order of 0.3 K (actually, 0.25K in FIG. 1B), or more, at temperatures of about 4 K, (e.g., 3.35K to 3.6K shown in FIG. 1B). In many applications, such as for cooling superconducting devices (e.g., device 226 in FIGS. 1A and 2) which have a strong temperature dependence, these temperature oscillations (e.g., of about 0.3K) are problematic since they may cause malfunctions of the devices.

Thus, it is desirable and/or necessary to have a very steady (substantially non-varying) operating cryogenic temperature (e.g., 4K) for proper operation of certain devices (e.g., superconductive circuits, superconducting magnets). A desired operating temperature (i.e., Td) may be selected or set within a predetermined range; but, once Td is reached, it is desirable to maintain the temperature within narrow margins (typically of order 1% or less). Variations/oscillations about the value of Td, even if relatively small, are undesirable because the operation of the devices (e.g., superconductive devices) being cooled is temperature dependent and is adversely affected by temperature variations.

It is therefore desirable and/or necessary to reduce thermal oscillations or variations of the coldest stage.

FIG. 2 shows a "thermal damper" apparatus which can be used to thermally dampen the temperature oscillations exhibited with the coldest stage of the system of FIG. 1A. The thermal damper includes a cryogenic fluid container 220 connected to a room-temperature helium gas reservoir 200 via a narrow capillary tube 210 to enable cooling fluid (helium gas) to flow between the reservoir and the container as a function of their respective pressures. Container 220 is thermally linked to the cold stage 260 via a thermal linkage 270. Gas reservoir 200 is located external to enclosure 230 and is operated at room temperature. Reservoir 200 provides a volume of gas which can flow in and out of cold container 220 and enables the sizing and construction of container 220 to be simpler and more practical.

As is known, He is a high thermal capacitance material at low temperatures. FIG. 2 shows that the gas in the thermal damper is physically separate from the working fluid of the rest of the cryocooler. The pressure of a fixed volume of He increases by more than a factor of 100 between 4K and 300K (room temperature), so that it is impractical to seal a sufficient quantity of He into a small volume in the cryogenic assembly while it is warm; the pressure would be much too large and would present a serious safety hazard. Instead, the cold container 220 is connected via a narrow capillary tube 210 to a larger gas reservoir 200 kept at room temperature.

For efficient operation, the capillary tube 210 is shown to be thermally linked to an intermediate cold stage 240 via a thermal linkage 250. The capillary tube may be formed of a low-thermal conductivity material such as stainless steel, so that in normal operation the tube itself does not transfer significant heat from room temperature to the cold stages.

Starting with the FIG. 2 system at room temperature, cooldown from room temperature is initiated by applying electrical power to the cryocooler (this includes powering ambient stage assembly 160 and compressor 150). Cooling stages 240 and 260 begin to cool down. This in turn causes the volume and the pressure in cold container 220 to decrease, causing additional gas from the room-temperature gas reservoir 200 to pass through the capillary tube 210 to the cold container 220. The cooldown process from room temperature continues until the cooling stage 260 reaches a desired temperature (e.g., Td is equal to 4K). Once Td is reached, the thermal capacitance of container 220 functions to reduce the amplitude of temperature oscillations/variations to very low levels (e.g., about 20 milliKelvins peak-to-peak) which is acceptable for operation of the device 226 being cooled.

However, in at least one respect, the system of FIG. 2 has a significant shortcoming. As is known, superconducting integrated circuits (SICs) based on rapid-single-flux-quantum logic (RSFQ) are very sensitive to the trapping of magnetic flux due to current transients and stray magnetic fields, which may prevent the proper operation of the SICs upon cool down. One solution to this problem is to thermally cycle the superconducting integrated circuits (SICs), from a desired operational temperature (e.g., a Td of 4K) to a "defluxing" temperature (TO greater than 10 K [at which temperature the niobium (Nb) superconductor reverts to its resistive state] permitting the trapped flux to escape. The system is then re-cooled down to 4 K to determine if proper operation has been attained. The process of raising and lowering the temperature (thermal cycling) is referred to as a thermal "deflux" cycle. If a first raising and lowering of the temperature is not successful, this "deflux" or defluxing thermal cycling may be repeated multiple times (as many as 10 or more times) until proper operation of the superconducting IC is achieved. However, the cooling cycle from 11K to 4K can be quite time consuming due in part to the use of the thermal damper. Each deflux cycle may take 30 minutes or more.

Thus, while thermal damping helps to maintain the desired operating temperature (e.g., Td) fixed (i.e., with very low levels of temperature oscillations), there are applications where thermal damping impedes with the need to rapidly cycle the temperature between a first temperature (e.g., the operating temperature Td) and another temperature (e.g., a higher temperature, Tf) to reduce, eliminate or minimize certain problems (e.g., trapped flux).

Therefore, a need exists for apparatus which can dampen temperature oscillations of a system, while allowing a rapid response of the system when the system is subjected to temperature cycling between different temperature levels. This is of particular importance where, for optimum operation, the temperature of certain devices being cooled must be operated at different temperature levels.

SUMMARY OF THE INVENTION

Apparatus embodying the invention includes a fluid control assembly connected between a cold gas container and a gas reservoir for controlling the flow of gas between the container and the reservoir.

In accordance with one embodiment of the invention, the fluid control assembly may be a passive valve assembly which automatically allows fluid flow from the gas reservoir to the gas container when the pressure in the reservoir exceeds the pressure in the container by an amount P1 and which automatically allows fluid flow from the gas container to the gas reservoir when the pressure in the container exceeds the pressure in the reservoir by an amount P2. P1 and P2 may be equal or have different values.

In accordance with another aspect of the invention, the fluid control assembly may be a fluid control valve activated in response to pressure or temperature signals derived from the container and reservoir and/or to satisfy selected system conditions. In one embodiment of this aspect of the invention, the fluid control valve may be an on-off valve. In another embodiment of this aspect of the invention, the fluid control valve may be a variable control valve with a plurality of flow restrictions controllable in the "on" state.

Systems embodying the invention may include means for sensing the functionality of devices attached to, and being cooled by, by the cold container and for automatically cycling the temperature of the cold container between different temperature levels to ensure the correct functionality of the devices being cooled.

Applicants' invention resides, in part, in the recognition that, in prior art systems of the type shown in FIG. 2 in which a cold gas container is coupled to a room temperature gas reservoir via a tube, the cooldown of the cold gas container from an intermediate temperature (e.g., 10K) to a desired operational value (e.g., 4K) is slowed because of the continuous flow or exchange of gas (e.g., He) between the room temperature gas reservoir and the cold gas container.

The slow cool down time reflects the time needed to extract the heat of additional gas sucked into the cold gas container from the room-temperature gas reservoir during the cool down. During the cooldown step, warm gas is now returned to the cold gas container with a large enthalpy. Even if the interconnecting tube is thermalized at an intermediate temperature, the heat load on the cryocooler stages is substantial and slows the cooldown response. Therefore, Applicants recognized the need to restrict the gas flow during temperature changes at low temperatures (e.g., 11K to 4K), while permitting essentially unimpeded gas flow during larger thermal excursions, such as the cooldown from room temperature when the cryocooler is initially activated, and warm up when the cryocooler power is turned off.

In addition to gas flow associated with the deliberate temperature excursions as described above, there will also be some gas flow associated with the "ac" temperature oscillations, at the cyclic frequency of order 1 Hz. This ac gas flow between the cold gas container and the room-temperature reservoir will transfer heat from the reservoir to the container during the cooling part of each cycle. While the amplitude of these temperature oscillations may be significantly reduced by the thermal damper, and hence the heat transferred per cycle will be small, the high frequency can lead to a significant average heat load on the container. This can reduce the available cooling power of cooling stage 260 during operation at either constant temperature or deliberate thermal cycling. This is undesirable in either case, and in particular, this heat load could slow the cooldown process associated with the deliberate thermal cycling.

By controlling the fluid flow for limited temperature excursions (both deliberate and oscillatory) a faster cooling process is enabled. Accordingly, one embodiment of the invention includes a valve assembly that restricts gas flow for relatively small pressure differences, but opens with high reliability when the pressure difference becomes large. In other embodiments pressure sensors may be used.

BRIEF DESCRIPTION OF THE DRAWINGS

In the accompanying drawings like reference characters denote like components.

FIG. 1B is a waveform diagram showing temperature oscillations present in the coldest stage of a cryocooling system of the type shown in FIG. 1A;

DETAILED DESCRIPTION OF THE INVENTION

Figure 3:
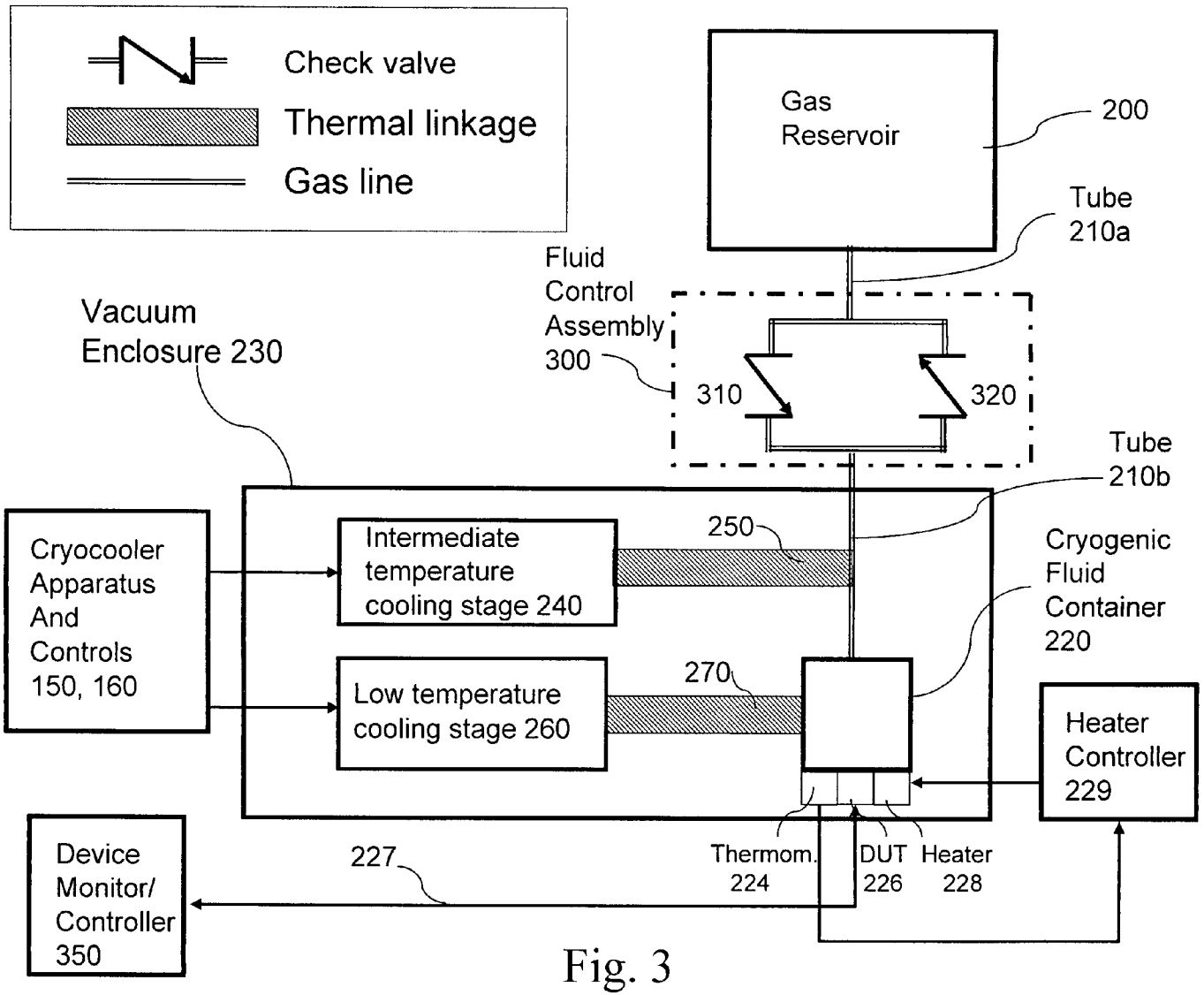
FIG. 3 is a simplified block diagram of a cryocooling system embodying the invention, using a fluid control assembly to modify the prior art system of FIG. 2 and increasing the cool down response time of the system.

FIG. 3 shows that, in systems embodying the invention, the prior art thermal damper system consisting of a gas reservoir 200 and a cryogenic container 220 is modified with a fluid control assembly (e.g., 300) to provide improved cool down performance when the cryo container is subjected to thermal cycling. As shown in FIG. 3, a fluid control assembly (e.g., 300) inserted in the gas/fluid line connecting a cryogenic container (e.g., 220) with a gas reservoir (e.g., 200).

Reservoir 200, designed to hold a volume of gas (e.g., He), is typically maintained at room temperature. It is coupled via a first tube 210*a*, (which may also be denoted as a conduit, (which need not be a capillary tube) to one side (arbitrarily also referred to as the "top" side) of a fluid control assembly 300. The other side (arbitrarily referred to as the "bottom" side) of fluid control assembly 300 is coupled via a second tube 210*b* (which may also be denoted as a conduit) to container 220 which is suitable for holding a cryogenic fluid (e.g., He) in its liquid or gaseous form. Tube 210*b* may be formed with a small internal diameter to function as a capillary tube.

The container 220 is located within vacuum enclosure 230 in which is included: (a) a first intermediate temperature cooling stage 240 coupled via a thermal linkage to tube 210*b*; and (b) a second, low temperature cooling stage 260 coupled via thermal link 270 to container 220 to provide cryocooling to container 220. The operation of cooling stages 240 and 260 is controlled by crycooler apparatus and controls 150, 160.

Container 220 may be any metallic (or other suitable material) chamber capable of holding a volume of gas/liquid subjected to the pressure and temperature variations of the system; or it may contain materials and structures designed to enhance the heat exchange between the gas and the exterior of the chamber. In the discussion to follow, the cryogenic fluid container 220 may also be referred to as the "cryo chamber" or "cryo-container." Devices (e.g., 226) to be cooled and/or thermally cycled are attached via a very low impedance thermal connection to container 220 or may be inserted within the container.

In FIG. 3, the fluid control assembly 300 includes two standard in-line pressure relief valves (310, 320) connected in an anti-parallel configuration. Each one of valves 310, 320 permits fluid flow in only one direction, as indicated by an arrow in the drawing, when the pressure difference across the valve exceeds a threshold differential value. The flow-pressure characteristics of an anti-parallel combination of relief valves shown in FIG. 3 is given in FIG. 4, for both signs of pressure difference. Note that for pressure differences of either sign below a given threshold, there is no gas flow between the container and the reservoir. (i.e., fluid flow is blocked). For relatively small excursions in temperature and pressure, such as occur during the 1-Hz temperature oscillations, no gas exchange between the container and the reservoir can occur.

Thus, the fluid control assembly 300 is designed to restrict/control gas flow between the gas reservoir 200 and the cryo chamber 220 for modest pressure differences across the valve assembly, while permitting essentially unrestricted gas flow between the reservoir 200 and the cryo chamber 220 for larger pressure differences. Each valve functions in an analogous manner to an electrical diode, which permits current flow only in a single direction when the voltage across the diode exceeds a threshold voltage in the preferred direction.

For the selected pressure relief valves, 310, 320, there is a threshold differential pressure, known as the "cracking pressure" $P_c$. The two valves 310 and 320 may be, but need not be, identical. They are connected in parallel branches, but are oriented to transfer or pass gas in opposite directions. Thus: (a) if gas is to flow from the cryo-chamber 220 toward gas reservoir 200, it must/will flow through valve 320 when the pressure in cryo-chamber 220 is greater than the pressure in gas reservoir 200 by an amount PC2; and (b) if the gas is to flow from gas reservoir 200 to cryo-chamber 220 it must/will flow through valve 310 when the pressure in gas reservoir 200 is greater than the pressure in cryo-chamber 220 by an amount PC1.

Figure 4:
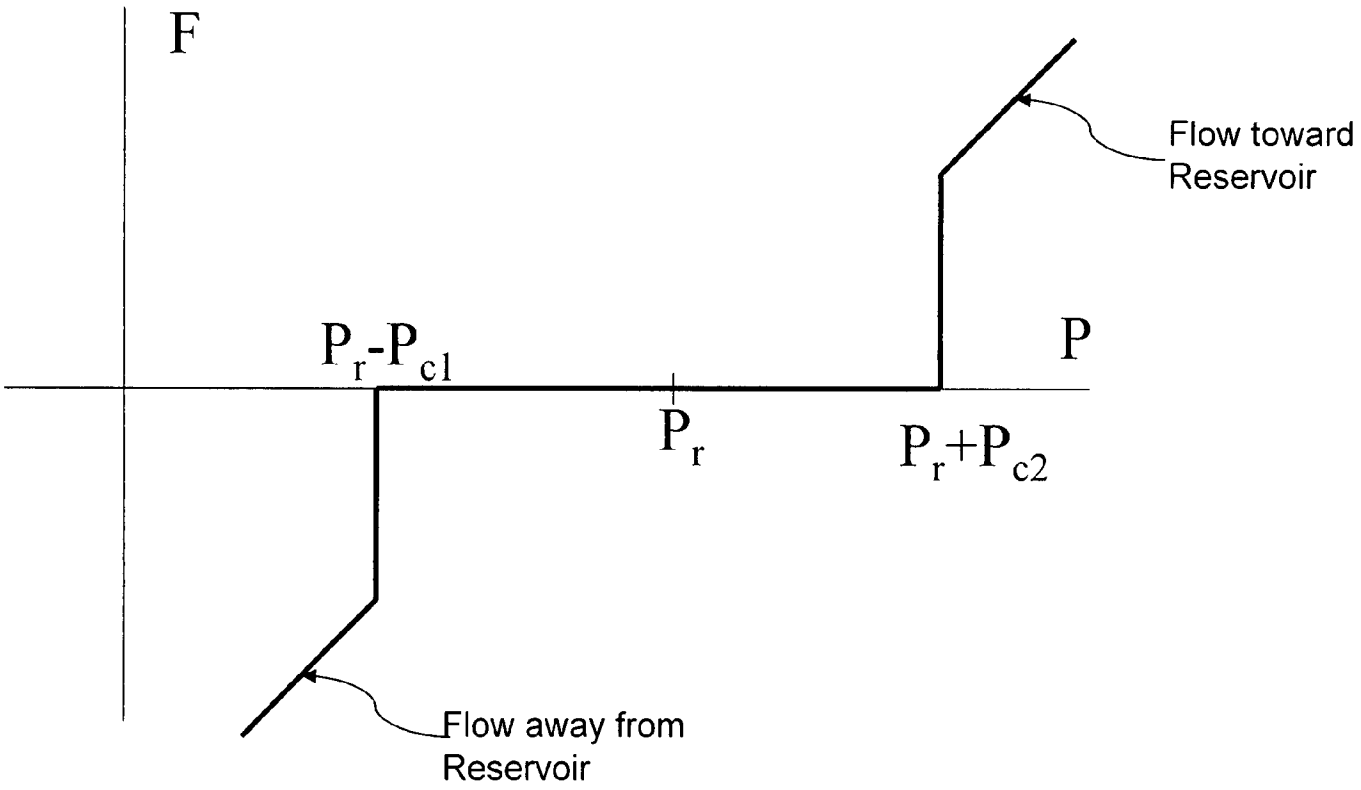
FIG. 4 is an idealized diagram showing the pressure dependence of gas flow for the anti-parallel valve configuration of FIG. 3.

An idealized plot of the dependence of the gas flow across the valve assembly 300 as a function of gas pressure across the valve assembly is shown in FIG. 4. The transfer function shown in FIG. 4 is an approximation of an actual pressure-flow transfer function. In practice, the infinitely steep shoulders shown at the threshold points would be somewhat more gradual, time dependent, and possibly slightly hysteretic (sticky) for actual valves. However, the general mode of operation described here is valid.

In FIG. 4, positive F (above the abscissa) represents gas flow from the cryogenic gas container 220 into the room temperature reservoir 200, and negative F (below the abscissa) represents gas flow from the room temperature reservoir 200 to the cryogenic gas container 220. $P_r$ represents the reference pressure of the gas in the room-temperature reservoir 200, $P_{c1}$ is the differential "cracking pressure" of valve 310 of the valve assembly 300 for flow toward the cryogenic gas container 220, and $P_{c2}$ is the cracking pressure of valve 320 for gas flow from the cryogenic gas container 220 toward the room temperature gas reservoir 200. In general, $P_{c1}$ and $P_{c2}$ may have, but need not have, the same values.

Further, as detailed below, during a deflux temperature cycle, the temperature of the container 220 is cycled between a first value (e.g., 4K) and a second value (e.g., 11K). With the insertion of the valve assembly, the total mass of fluid/gas that flows between the cold container 220 and the warm reservoir 200 is substantially reduced or eliminated, since a differential pressure exceeding the pressure threshold of the relief valve is needed to open the valve and initiate gas flow.

In contrast, without such a valve assembly, when the container temperature rises, increased pressure forces some gas from the container to the room temperature reservoir. When the container temperature falls again, the decreased pressure will suck back this warm gas, creating a substantial heat load that slows the cool down process. This gas exchange is at least partially blocked by the valve assembly in the modified thermal damper of this invention, eliminating or reducing this additional heat load on cool down.

The operation of the system with the valve assembly may be explained, by assuming, for ease of illustration only, that the volume of the gas reservoir 200 is large enough so that $P_r$ does not change significantly during the process and ignoring the effect of temperature oscillations. (The assumption is for purpose of illustration only and the invention is not limited to such a requirement).

Consider a starting state with the system including the gas within reservoir 200 and cryo chamber 220 being at room temperature, and at a pressure both below and above the valve of $P_r$. Assume now that the cooling system is energized and that cooling stage 260 is operational and lowering the temperature of plate/thermal link 270 causing cryo container 220 to start to cool down. The volume of the gas within the chamber decreases and its pressure decreases from $P_r$. When the pressure falls below $P_r-P_{c1}$, additional gas flows from the reservoir 200 into the cryo container 220. The system operating point remains at this pressure ($P_r-P_{c1}$) until the minimum temperature is reached, where it remains, but with no gas flow.

When the system heats up (e.g., either by energy heater element 228 and/or shutting down the cooling system), the pressure in container 220 increases towards $P_r+P_{c2}$. If, and when, this second threshold, $P_r+P_{c2}$, is reached, the system sits at this operating point, permitting gas flow from container 220 to gas reservoir 200 to prevent the pressure in container 220 from rising further.

For thermal cycling over small temperature differences, the system will move in the range between these two set points, but with generally no gas flow. For larger temperature excursions, the system may sit at either set point ($P_r-P_{c1}$ or $P_r+P_{c2}$), with the relevant relief valve open until the system stabilizes.

It is significant that as long as the pressure differential is within the range between $P_r-P_{c1}$ and $P_r+P_{c2}$ there is no gas flow between the gas reservoir 200 and the cryo container 220. For this range of pressure, a significantly lower volume of gas has to be cooled or heated, enabling the much faster cooling operation illustrated in FIG. 5.

Figure 5:
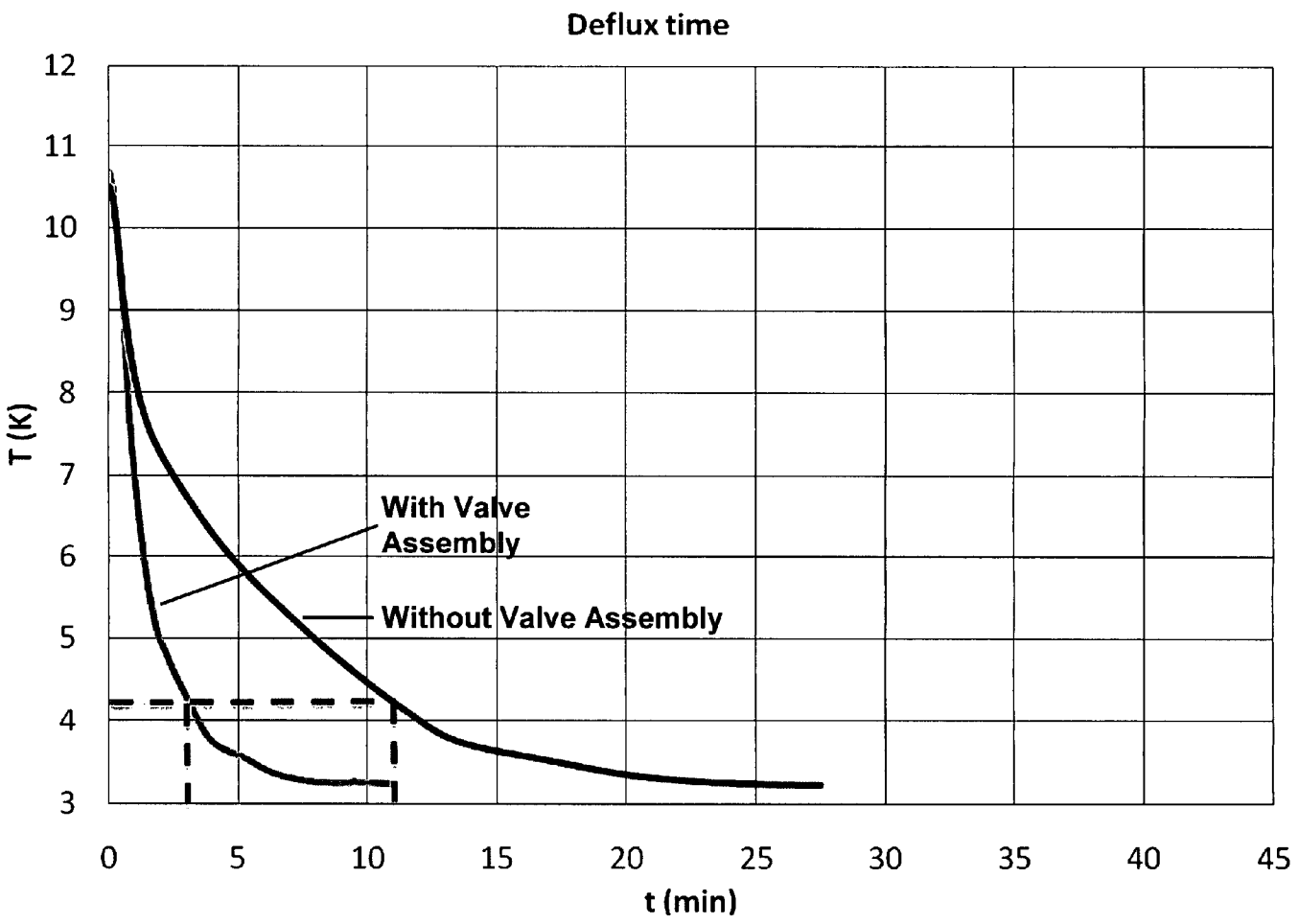
FIG. 5 is a waveform diagram showing the cool down time for a system embodying the invention when compared to a prior art system.

Direct measurements of the time dependence of cooldown in a cryocooler from 11 K to 4 K, with and without the valve assembly, are shown in FIG. 5, and clearly indicate a substantial improvement in cooldown time with the valve assembly. Note from FIG. 5 that cycling from 11K to 4K took approximately 3 minutes with the valve assembly in the system as compared to approximately 12 minutes without the valve assembly. This is a 4 to 1 improvement which is even more marked at temperatures below 4K. Thus, the cool down time is substantially reduced to an acceptable time range when using the valve assembly. Furthermore, the desirable suppression of thermal oscillations is maintained.

For the measurements and results shown in FIG. 5, the valves used were commercially available in-line pressure relief valves that open for a differential "cracking pressure" $P_c$ of 3 bars (around 44 psi), and the reference pressure $P_r$ was about 10 bars (about 147 psi). Proper selection of $P_c$ is necessary for optimum operation of the invention; either too low or too high a cracking pressure would obviate the advantages obtained using the valves.

Any one way valve that in operation has the general characteristics shown in FIG. 4 may be used to practice the invention. For example, a check valve comprises a spring-loaded seal that permits gas flow only when the pressure across it exceeds some calibrated positive value, determined by the spring constant. The valve closes again as soon as the differential pressure decreases below this set point. Check valves are available commercially for applications in liquid and gas flow control. For example, a check valve may serve as a safety valve to prevent buildup of excess pressure, in which case it is known as a pressure relief valve. An in-line pressure relief valve is such a check valve in which the relieving fluid flow is confined within a tube rather than vented to the atmosphere.

In the embodiment of FIG. 3, gas reservoir 200, tube 210*a* and the valve assembly 300 together with its components were designed to be operated at room temperature. This operation provides a greater freedom in the selection of components and results in a less expensive design. Note that the valve assembly 300 may be relocated within the vacuum enclosure; but the valves would then have to be operable at the cryogenic temperatures present within the enclosure.

Figure 1A:
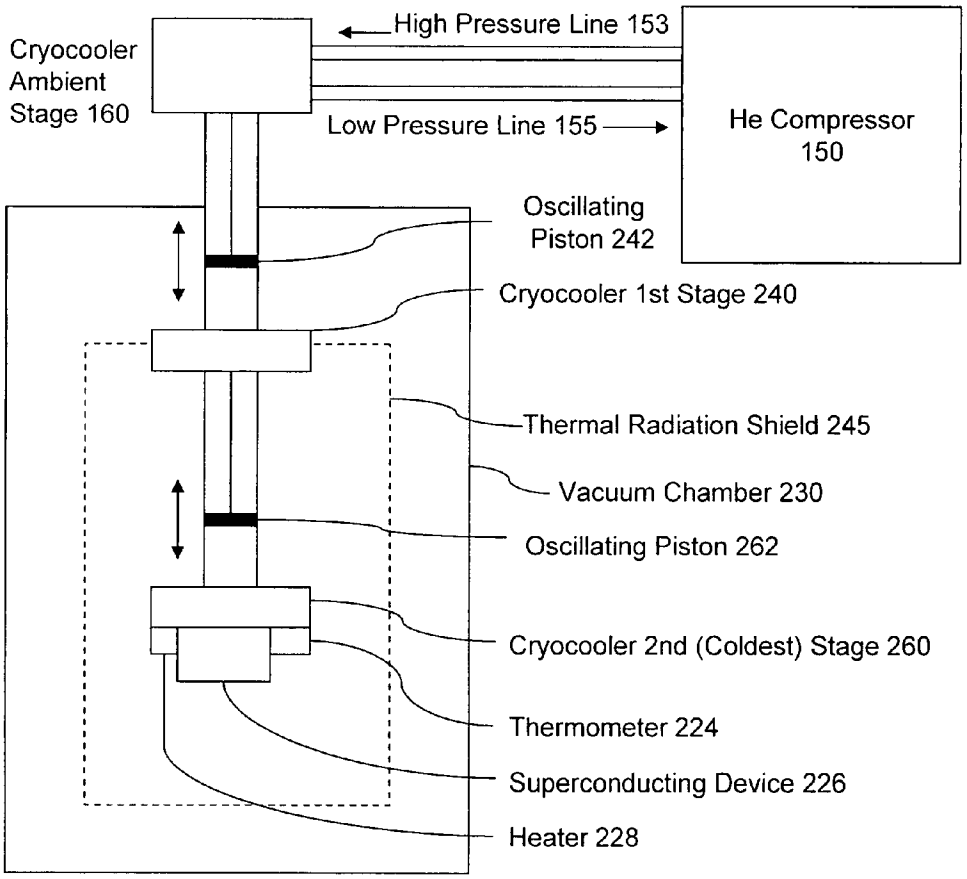
Fig. 1A. Prior Art
FIG. 1A is a highly simplified block diagram of a prior-art cryocooling system for cooling a superconducting device to cryogenic temperatures near 4 K.
Figure 2:
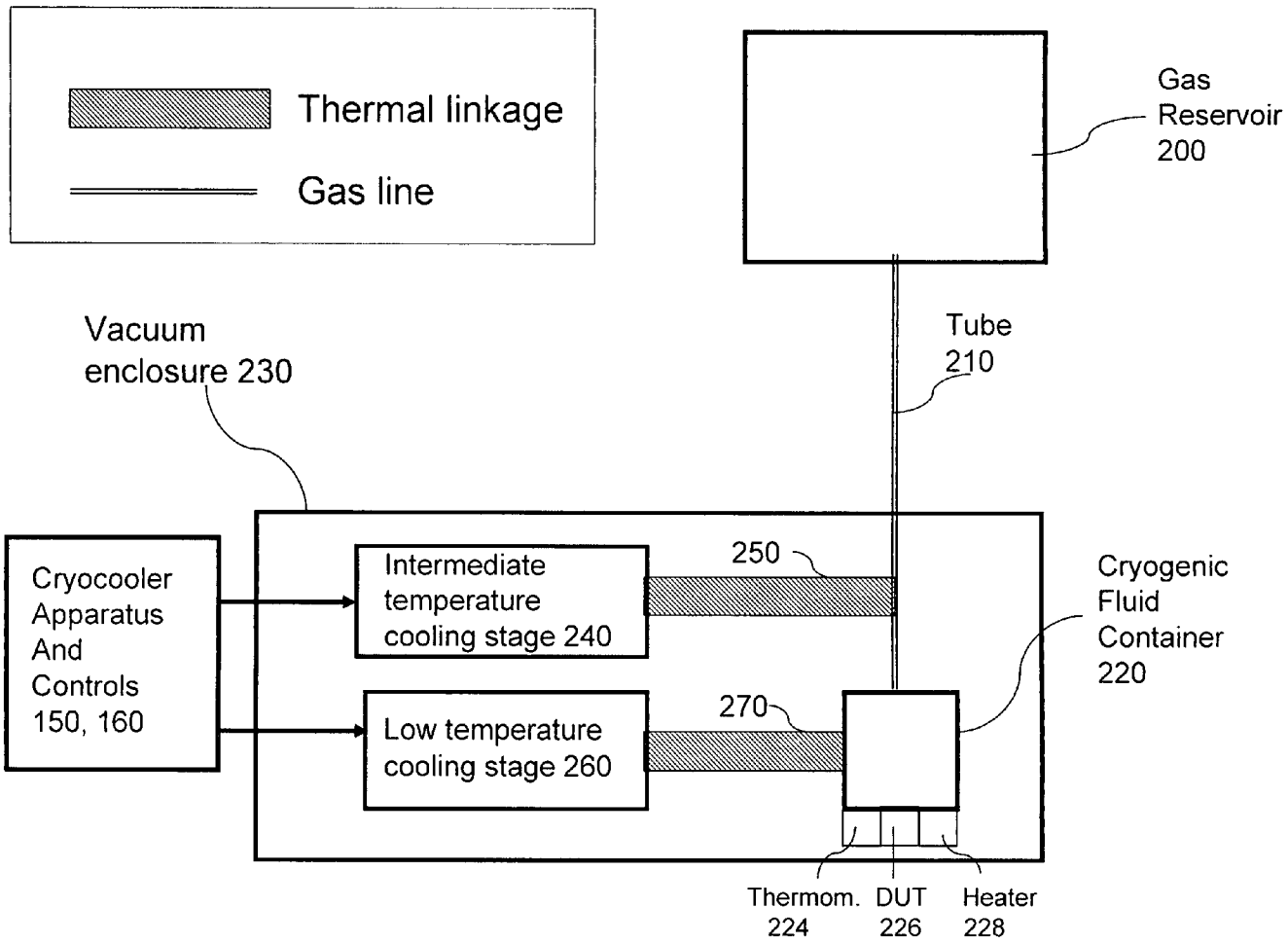
Fig. 2. Prior Art
FIG. 2 is a highly simplified block diagram of a prior-art cryocooling system including a thermal damper for reducing temperature oscillations exhibited in the FIG. 1A system.

Note that in FIG. 3, by using the valve assembly, tube 210*a* need not be a capillary tube and have the restricted and/or expensive characteristics of capillary tube 210 in FIG. 2.

A system of the type shown in FIG. 3 was built and tested. The gas used was Helium and when the entire system was at room temperature, the pressure of the gas distributed through reservoir 200, the interconnecting tubes, the valve assembly and cryo container 220 was about 20 bars. When the cryogenic container 220 was cooled down to around 4 K, the overall pressure of the gas in the gas reservoir and the cryo container was reduced to about 10 bars (e.g., Pr=10 bars). The two anti-parallel pressure relief valves, as shown in the configuration described in FIG. 3, were each selected to have a cracking pressure $P_c$ of 3 bars. This would correspond in FIG. 4 to the valves being closed for pressures in the cryogenic container volume between about 7 bars and 13 bars [10 bars plus and minus 3]. This range is sufficient to prevent gas transfer during temperature oscillations. [Note: If the pressure in container 220 is greater than the critical point of helium (about 2 bars at 5 K, where the boiling transition line ends), then the helium will not liquefy, but will remain a dense gas.]

The system of FIG. 3, like that of FIG. 2, also operates to dampen temperature oscillations. If the temperature oscillations are at a frequency that is relatively low (such as 1 Hz), then the flow-pressure transfer function should be similar to the static transfer function shown in FIG. 4. If the frequency of the temperature oscillations is much higher, then this transfer function may need to be modified, but a qualitatively similar behavior would be expected. Such a temperature oscillation would cause the system pressure to oscillate in the zero-flow region for modest variations in temperature. Larger variations would cause the system to operate for parts of the cycle at the thresholds, permitting gas flow in either direction to avoid excessive pressure buildup.

The embodiment of FIG. 3 using in-line pressure relief valves has some key advantages in terms of hardware availability. The relief valves operate passively and automatically in response to a given pressure differential and do not significantly restrict fluid flow during large variations in temperature and pressure, when free flow of gas between low and high temperatures is needed for proper operation and safety. This invention is not restricted to this particular embodiment and these specific valves. Any other valves or valve arrangement suitable for controlling fluid flow for low differential pressures while permitting it for high pressure are within the ambit of the invention. Thus, other valve assemblies with similar transfer functions can also be used. The system of FIG. 3 may include a valve assembly which would be responsive to signals generated by pressure sensors which measure the pressure difference across the valve assembly. Different valves of the valve assembly would be opened and closed as a function of the sensed pressure differentials.

Figure 3A:
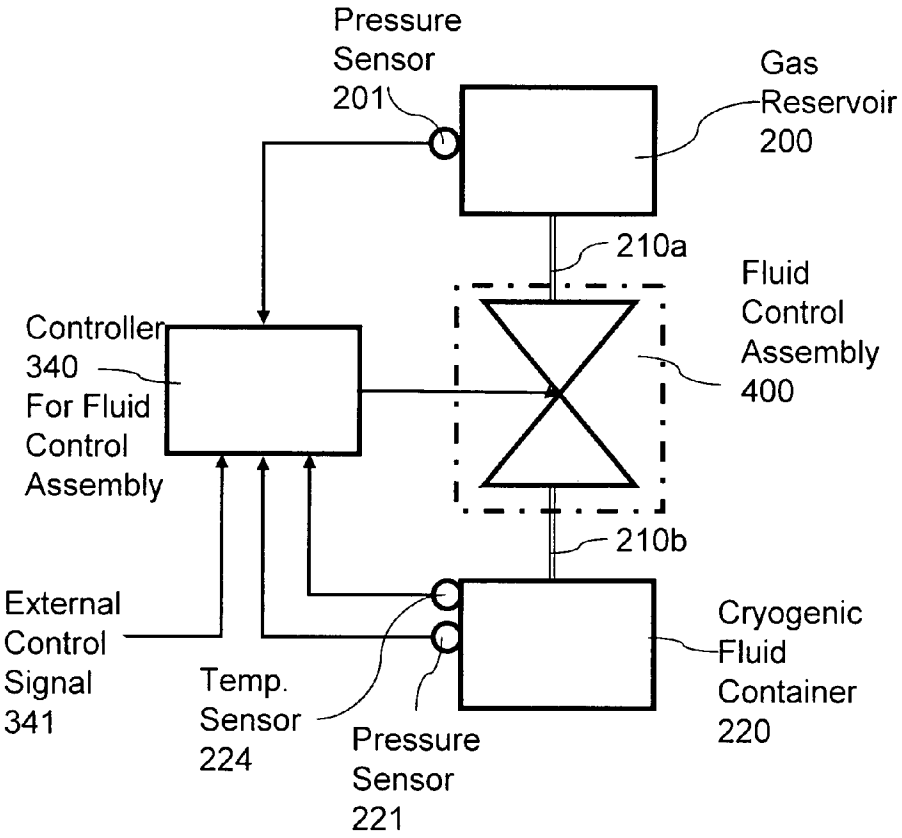
FIG. 3A is a block diagram of portions of a cryocooling system embodying the invention, using a fluid control assembly comprising a controllable valve to control fluid flow between a cryogenic gas container and a gas reservoir operated at room temperature.
Figure 3B:
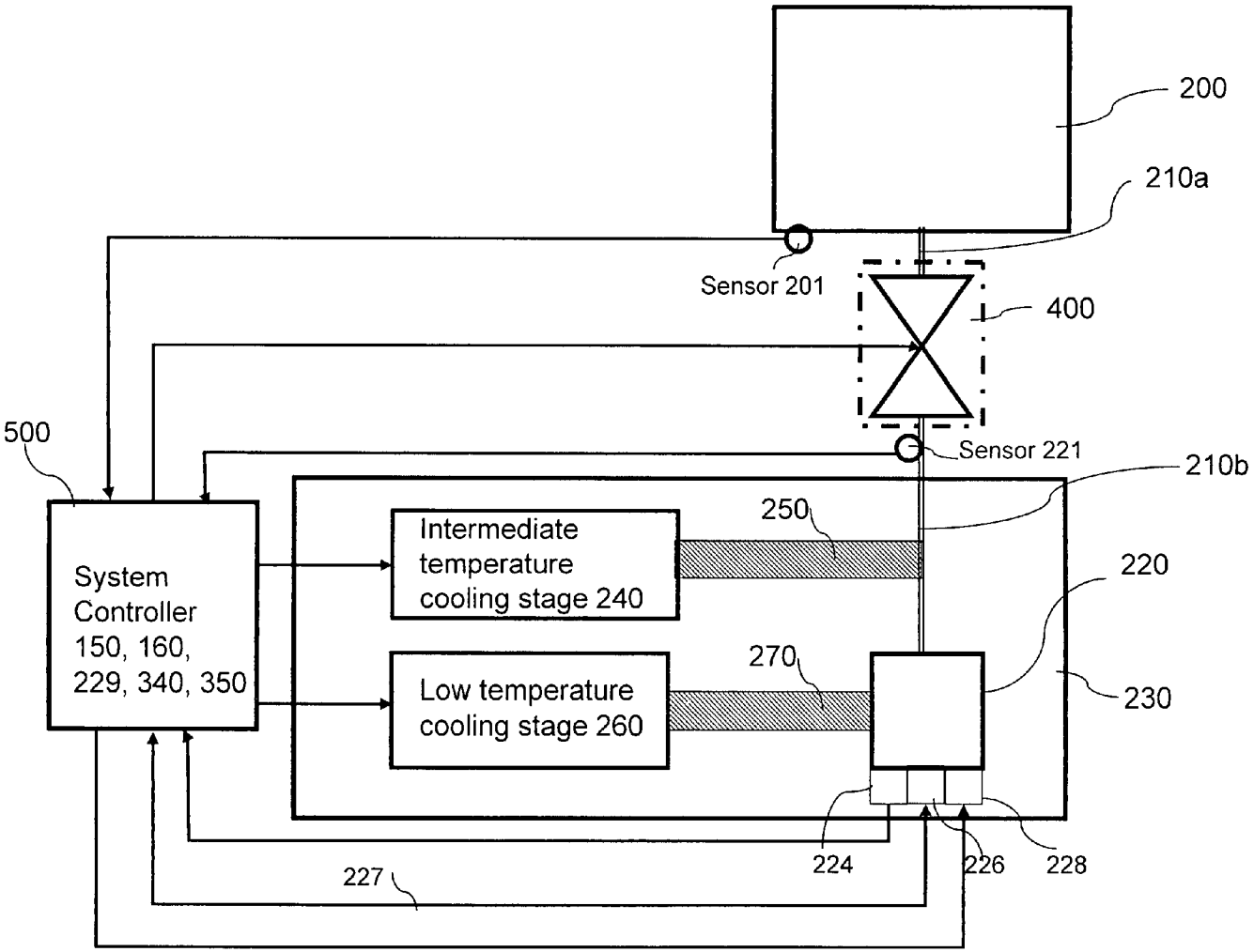
FIG. 3B is a block diagram of a cryocooling system embodying the invention suitable for producing selected cryogenic temperatures and temperature cycling a device to be cooled and sensing its functionality.

Other embodiments of the invention are shown in FIGS. 3A and 3B. FIG. 3A is a highly simplified block diagram of a system for modifying a thermal damper in accordance with the invention. In FIG. 3A, the passively operated controlled fluid control assembly 300 of FIG. 3 is replaced with an electronically/electrically controlled valve assembly 400 which enables active control of fluid flow. In one embodiment of FIG. 3A, the fluid control assembly 400 includes an ON-OFF (shut off) valve coupled via a tube 210*a* to a gas reservoir 200 and via a tube 210*b* to cryo container 220. A pressure sensor 201 which senses the pressure in reservoir 200 and a pressure sensor 221 which senses the pressure in cryocooler container 220 are shown coupled to a valve controller 340 and supply sensed signals to the controller. A temperature sensor 224 which senses the temperature in cryocooler container 220 may also be coupled to valve controller 340 to supply sensed signals to the controller. The controller 340 includes circuitry programmed to be responsive to the pressure and/or temperature signals from the container 220 and reservoir 200 for turning the valve 400 ON or OFF. When valve 400 is turned ON, the direction of fluid flow between the reservoir and the container will be a function of which one is at a higher pressure. In addition, an external control signal 341 may also be supplied to controller 340 to activate and/or deactivate the valve. Note that valve 400 acts as a controllable on-off switch which in the ON condition allows fluid flow and in the OFF condition blocks fluid flow. This configuration enables regulation of the fluid flow in a very controlled and precise manner.

In an alternative embodiment of the invention as shown in FIG. 3A, the valve 400 comprises a variable control valve, wherein the flow restriction in the "on" state may take one of a plurality of different values or even a continuous range of values. The value of the flow restriction may be electrically or electronically controlled, depending on either a temperature sensor or a pressure sensor. This may permit additional flexibility of the speed and dynamic range of the control system. The variable or proportional control valve may be of the type designated as Porter EPC made by Porter Instruments or as described in U.S. Pat. No. 4,417,312 or any like suitable valve.

FIG. 3B is a highly simplified block diagram of a cryocooler system including a prior art thermal damper modified with a fluid control assembly suitable for automatically providing the requisite cooling environment and temperature cycling for any device to be cooled such as superconducting integrated circuits or magnets. In FIG. 3B the pressure and temperature sensors (201, 221, 224) from the reservoir 200 and cryo-chamber 220 are shown coupled to a system controller 500 and supply their respective signals to appropriate processing circuits. For ease of description, system controller 500 includes cryocooler apparatus and controls 150, 160, heater controller 229, fluid control assembly controller 340 and device controller 350. The device 226 being cooled and requiring temperature cycling is attached to the container 220. A cable 227 is shown connected between the device 226 and controller 500 to enable the testing and/or sensing of the operation device 226.

Some devices to be cooled are subject to transient flux trapping events, such as might be associated with a transient power interruption or fluctuation in power levels. A system, such as the system of FIG. 3B, can be used to automatically thermally cycle the devices to be cooled and enable them to automatically recover from flux trapping.

As already discussed, the invention is particularly useful to enable the rapid cycling of the temperature of the cryo container 220, for example, between 4K and 11K. Raising the temperature of the cryo container from a desired operating temperature (e.g., Td=4K) to a temperature Tf (e.g., 11K or any other selected temperature which can cause defluxing of a superconducting IC being cooled) may be accomplished by energizing the heater 228 (i.e., applying power to its heater coil). Energizing the heater 228 can be done while the cooling system is on, and remains on, or concurrently turning off the cooling system. The temperature of the cryo-container 220 and its associated thermal linkage 270 may be monitored or sensed by temperature sensor 224. When the cryo container reaches Tf, the heater is deenergized and the cryo container 220 is cooled to 4K. The superconducting IC (SIC) is then tested to ascertain whether it is "defluxed" and ready for operation. In the event that the SIC is not totally defluxed, the thermal cycling process (4K to Tf to 4K) is repeated, until the SIC is fully operational.

In accordance with the invention, the entire thermal cycling process resulting in ensuring that the SIC is fully operational may be fully automated with the controller 500 and its constituent processors may be programmed to test the operability of the SIC and to cause the thermal cycling until the SIC is defluxed.

As noted above, FIG. 5 shows the measured cool down from such a defluxing cycle, with the valve assembly of FIG. 3 and without the valve assembly present. Clearly, the cool down is much faster with the valve assembly present. The cool down may be even faster with a fully optimized valve assembly (as per FIGS. 3A and 3B) designed to block gas transfer during the entire defluxing cycle.

While this invention has been described in connection with a superconducting device that is designed to operate at a single fixed temperature, a similar temperature regulation system could also be applied to scan device operation over a range of temperatures. The ability to do this quickly and reproducibly, under automated program control, would be a great advantage.

What is claimed is:

1. A method for enabling rapid thermal cycling of a cryocooling system, the cryocooling system including:

(i) a container operated at cryogenic temperatures;

(ii) a cryocooling and heating apparatus thermally attached to said container to provide cryocooling and heating to the container;

(iii) a superconducting integrated circuit SIC thermally attached to the container, said SIC having a cryogenic operating temperature Td, and said SIC requiring defluxing in order to be rendered operable, said defluxing occurring when the temperature of the SIC is raised from Td to a temperature Tf, the defluxing occurring at Tf;

(iv) a gas reservoir for holding a volume of fluid in gaseous form;

(v) a fluid control valve assembly coupled between said container and said gas reservoir for controlling the flow of the fluid between the container and the gas reservoir as a function of the pressure difference between the gas reservoir and the container;

the method comprising the steps of:

selectively thermally cycling the temperature of the container between Td and Tf, said fluid control valve assembly having:

(a) a first cracking pressure, Pc2, such that the pressure in the container must exceed the pressure in the reservoir by Pc2 for fluid to flow from the container to the gas reservoir, whereby the fluid control valve assembly blocks the flow of fluid from the container to the gas reservoir when the temperature of the container is increased from Td to Tf; and, (b) a second cracking pressure, Pc1, such that the pressure in the gas reservoir must exceed the pressure in the container by Pc1 for fluid to flow from the gas reservoir to the container, whereby the fluid control valve assembly blocks the flow of fluid from the gas reservoir into the container when the temperature of the container is lowered from Tf to Td.

2. The method as claimed in claim 1, wherein said fluid control valve assembly:

(a) blocks the flow of fluid from the gas reservoir to the container until the pressure in the gas reservoir exceeds that in the container by the second cracking pressure Pc1; and (b) blocks the flow of fluid from the container to the gas reservoir until the pressure in the container exceeds that in the gas reservoir by the first cracking pressure Pc2, wherein Pc1 is 3 bar and Pc2 is 3 bar.

3. The method as claimed in claim 1, wherein the fluid control valve assembly includes at least one valve.

4. The method as claimed in claim 1, wherein the fluid control valve assembly includes:

(a) a first unidirectional conducting valve having the second cracking pressure Pc1 for blocking fluid flow from the gas reservoir to the container until the pressure across the first unidirectional conducting valve exceeds Pc1; and (b) a second unidirectional conducting valve having the first cracking pressure Pc2 for blocking fluid flow from the container to the gas reservoir until the pressure across the second unidirectional conducting valve exceeds Pc2, where Pc2 is a value which blocks flow of fluid from the container into the gas reservoir when the temperature of the container is raised to Tf.

5. The method as claimed in claim 1, wherein the fluid control valve assembly includes:

(a) a first unidirectional conducting valve having the first cracking pressure Pc2 and (b) a second unidirectional conducting valve having the second cracking pressure Pc1, wherein the first cracking pressure Pc 2 is 3 bar and the second cracking pressure Pc1 is 3 bar, wherein each one of the first and second unidirectional conducting valves blocks the flow of fluid through it until its respective cracking pressure is exceeded, and wherein the fluid control valve assembly functions to block the flow of gas between the gas reservoir and the container when the pressure across the valve assembly is below said first and second cracking pressures.

6. The method as claimed in claim 1, wherein said SIC is thermally linked to the container such that the temperature of the SIC is determined by the temperature of the container.

7. The method as claimed in claim 1, wherein the fluid control valve assembly enables transfer of fluid from the gas reservoir to the container upon cooling of the container from room temperature down to a cryogenic temperature.

8. The method as claimed in claim 1, wherein the fluid control valve assembly enables gas transfer from the container to the gas reservoir when the container is heated and the pressure differential between the gas reservoir and the container is greater than the first cracking pressure Pc2.

9. The method as claimed in claim 1, wherein the fluid control valve assembly includes:

a controllable shut off valve having an ON state permitting fluid flow therethrough and having an OFF state inhibiting fluid flow therethrough, and at least one selected from the group consisting of temperature sensors and pressure sensors for selectively setting the controllable shut off valve to the ON state or the OFF state.

10. The method as claimed in claim 1, wherein the fluid control valve assembly includes a variable controllable valve whereby the magnitude of fluid flow is controlled depending on at least one selected from the group consisting of pressure sensors and temperature sensors for selectively setting the magnitude of the flow.

11. The method as claimed in claim 9, further including a data processor responsive to at least one of the pressure sensors and the temperature sensors for activating the controllable shut off valve.

12. The method as claimed in claim 1, wherein the fluid control valve assembly is a passive in-line valve assembly including a first unidirectional conducting valve and a second unidirectional conducting valve which automatically controls the fluid flow between the gas reservoir and the container.

13. The method as claimed in claim 1, further including:

a temperature sensor thermally linked to the container for sensing the temperature of the container, wherein said cryocooling and heating apparatus includes a heater attached to the container for raising the temperature of the container, wherein said cryocooling and heating apparatus and said temperature sensor function to thermally cycle the SIC by raising the temperature of the container from Td to Tf and to then turn off the heater and cool the container to Td.

14. The method as claimed in claim 13, further including a controller for testing the SIC to determine whether the SIC is defluxed and for automatically repeating the thermal cycling if the SIC is not defluxed.

* * * * *